US005883573A

United States Patent [19]

Mazeiko, Jr. et al.

[11] Patent Number: 5,883,573

[45] Date of Patent: Mar. 16, 1999

[54] MESSAGE GENERATION SUPERVISION SYSTEM

[75] Inventors: Edward J. Mazeiko, Jr., New Haven; Michael A. Troiano, Jr., South Meriden, both of Conn.

[73] Assignee: Pittway Corporation, Chicago, Ill.

[21] Appl. No.: 902,842

[22] Filed: Jul. 30, 1997

[51] Int. Cl.[6] ..... G08B 29/10

[52] U.S. Cl. ..... 340/506; 340/650; 340/652; 340/661; 340/692; 381/56; 381/58; 381/59

[58] Field of Search ..... 340/506, 510, 340/516, 628, 692, 653, 652, 651, 650, 661; 381/56, 58, 59

[56] References Cited

U.S. PATENT DOCUMENTS

| | | | |
|---|---|---|---|
| 5,532,601 | 7/1996 | Weir et al. | 340/650 |
| 5,539,389 | 7/1996 | Bystrak et al. | 340/825.52 |
| 5,604,479 | 2/1997 | Chang | 340/692 |
| 5,663,714 | 9/1997 | Fray | 340/692 |

OTHER PUBLICATIONS

Information Storage Devices, Inc., ISD2500 Series, Product Data Sheets 1–79 to 1–106, undated.

Gentex Corporation, SPK Speaker 1/4–2W Series, Product Data Sheet, Undated.

Notifier Division of Pittway Corporation, ET Series Speakers and Optional Strobes, Catalog Sectikon: Audio/Visual Appliances, pp. 1–6.

Notifier Division of Pittway Corporation, V400 and SP100 Speakers With Optional Strobes, Catalog Section: Audio/Visual Appliances, Apr. 18, 1995, pp. 1–4.

Notifier Division of Pittway Corporation. Series E Low Profile Wheelock Speakers & Strobe Speakers, Aug. 12, 1996, Section: Audio/Visual Appliances, pp. 1–4.

*Primary Examiner*—Glen Swann

*Attorney, Agent, or Firm*—Rockey, Milnamow & Katz, Ltd.

[57] ABSTRACT

Circuits for supervising message generators and audio output cables include memory for binary storage of messages previously recorded in a message generator. As the generator is cycled to produce an audio output, that analog output is sampled and compared to the previously stored binary representation. A match indicates a successful generation of the message. The cables can be supervised by applying a DC bias thereto and detecting the voltage present on the respective cable. Line integrity is indicated where the cable DC voltage falls in an expected range.

53 Claims, 4 Drawing Sheets

MESSAGE GENERATION SUPERVISION SYSTEM

FIELD OF THE INVENTION

The invention pertains to supervision circuits of a type usable in ambient condition detection systems. More particularly, the invention pertains to such circuits for supervising message generation devices and audio output links.

BACKGROUND OF THE INVENTION

Ambient condition detection systems for supervising one or more conditions in a selected region are known. One such system is disclosed and claimed in U.S. Pat. No. 5,539,389, entitled "Enhanced Group Addressing System", assigned to the assignee hereof. The disclosure of the '389 patent is incorporated herein by reference.

Ambient condition systems of the type disclosed in the '389 patent can be configured to detect, in one embodiment, fire profiles based on detected ambient conditions such as smoke, temperature or gas. In such fire detecting systems, it is known to provide audible and visible outputs, horns and strobe lights. These devices can be used to provide human perceptible indications of the presence of a detected fire profile. In this regard, voice annunciation systems have also been used. In such systems, audible messages can be pre-stored and played back at appropriate times to provide yet another form of communication for individuals in the region being supervised.

Where such annunciation systems are provided, it is desirable to be able to test same without alarming any individuals in the region where the test is being conducted. Preferably such testing could include not only annunciation system circuitry but also associated audio output cables. Also, it would be preferable if such supervision circuitry could be implemented without adding significantly to the cost or complexity of the associated system.

SUMMARY OF THE INVENTION

Message generator supervisory circuitry includes supervisory storage circuitry of a sampled message stored in the message generator. Control circuitry coupled to the message generator and to the storage circuitry causes the generator to output, as an audio signal, the stored message.

The output audio is in turn sampled by the control circuitry. The sampled audio is compared to the sampled, previously stored message. If the two signals are substantially the same, the message generator will have output the expected message or audio. If the signals differ, a tone generator will continue generating audio.

In one aspect, an analog output message can be cycled and sampled a number of times so as to form an average output sampled output signal. This averaged sampled signal can then be compared with a previously sampled and stored representation.

In yet another aspect, an averaged representation of the message can be pre-stored for subsequent comparison to the test analog output signal. In yet another aspect, when the test analog signal is being produced by the message generator, the audible output therefrom can be suppressed so as not to alarm individuals in the immediate area of the respective output transducers.

In a further aspect, various other types of audible and non-audible communications can be output by a system. These include paging messages, tones, background music and/or live announcements of all types.

In another embodiment, the audio output cables can be supervised even in the presence of output messages, paging announcements, background music, and tone generation. A supervisory signal can be applied to the output cables. The supervisory signal is electrically distinguishable from the electrical representation of any output signals that can be produced by the message generator or by any other input source. Further, the output transducers either do not respond to the supervisory signal or the output transducers are isolated from such signals.

The communications normally expected to be output by the system fall into a predetermined band which need not be limited to audio. The supervisory signals are all out-of-band signals. It will be understood that the exact details of the differences between the normally expected communications and supervisory signals are not limitations of the invention.

In one aspect, the supervisory signals can be in the form of a DC bias applied to the audio output lines. The output transducers, such as speakers, can be isolated by either capacitive or inductive coupling.

In another aspect, high frequency supervisory signals can be coupled to the audio output cables. The high frequency signals can be detected to verify cable integrity. However, the output transducers can be decoupled therefrom to minimize distortion. Alternately, low pass characteristics of the output transducers can be used to filter out the supervisory signals.

Numerous other advantages and features of the present invention will become readily apparent from the following detailed description of the invention and the embodiment thereof, from the claims and from the accompanying drawings.

DETAILED DESCRIPTION OF THE PREFERRED EMBODIMENT

Figure 1:
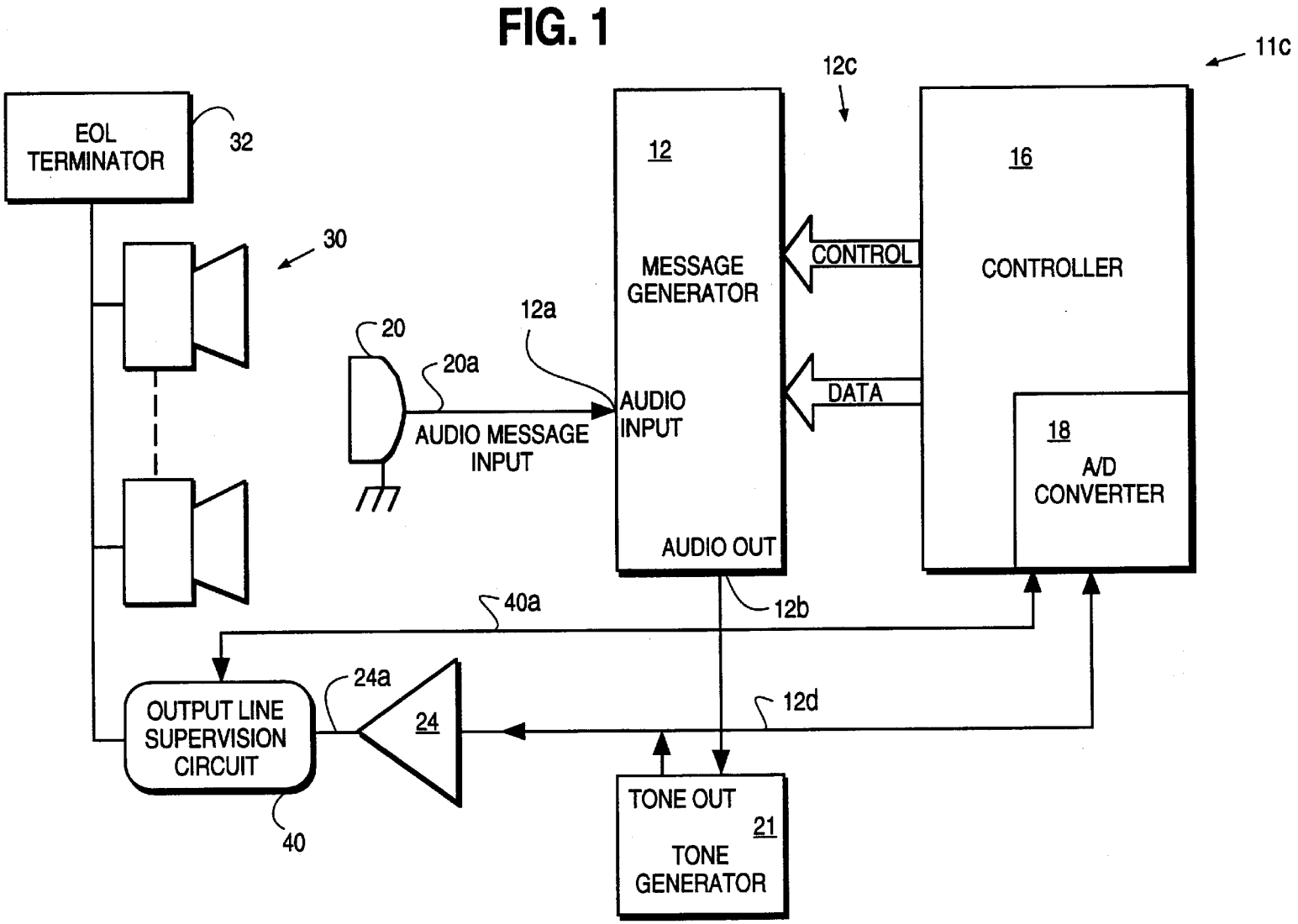
FIG. 1 is a block diagram of a supervised message generator.

While this invention is susceptible of embodiment in many different forms, there is shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates, in block diagram form, a supervisable message generation system 10. The system 10 incorporates message generation circuitry 12. The circuitry 12 could be implemented using commercially available digital signal processing circuitry such as Information Storage Devices type ISD2560. It will be understood that the exact details of the message generator 12 are not a limitation of the present invention.

The message generator 12 includes an audio input port 12*a* and an audio output port 12*b*. Control and data buses 12*c* couple the generator 12 to a programmable control unit 16.

The control unit 16 includes read/write memory for data as well as read-only memory usable for storage of control programs if desired. In addition, the unit 16 could also include magnetic storage in the form of disk drives and the like.

The control unit 16 in addition to interfacing with the generator 12 receives analog inputs at converter 18. The converter 18 samples the analog inputs, converts same to a binary representation which can then be stored in the storage units of the control unit 16.

A source of analog signals, such as microphone 20 can be used for entering one or more messages to be subsequently output by the generator 12. The analog signal for the microphone, on a line 20*a* is coupled to the audio input port 12*a* of the generator 12.

A tone generator 21, which could operate under the control of processor 16, is coupled to line 12*d*. The generator 21 can be used to produce one or more message-type tones.

Paging messages can be input via microphone 20. Alternately, other types of line messages or background music can be input by microphone or auxiliary jacks.

In a record mode, an electrical signal on the line 20*a* representative of a message to be output, is sampled and stored in both the generator 12 and storage circuitry for the control unit 16. It will be understood that the generator 12 could sample and store a plurality of messages without limitation. It will also be understood that various sources of audio signals can be used instead of microphone 20 without departing from the spirit and scope of the present invention.

Subsequent to sampling and storing one or more messages in generator 12 and control unit 16, the control unit 16, in accordance with a prestored control program, can command the generator 12 to output a selected message at the port 12*b*. The output message, in analog form, on line 12*d* is coupled to an input of the converter 18. The analog message is also coupled to an input of amplifier 24.

Amplifier 24 is in turn coupled to an output path or cable 24*a*. It will be understood that the amplifier 24 operates under control of the control unit 16 such that the output from the amplifier 24 can be disabled in response to a command or signal from the control unit 16.

For supervisory purposes, the analog signal on the line 12*d* can be sampled at converter 18 and compared by control unit 16 to a representation thereof prestored at the control unit 16 at the same time that the message had been previously stored in the generator 12. Thus, the supervisory mode of the system 10 not only verifies proper operation of the generator 12 to sample and store the selected message but it also verifies that the generator 12 has properly retrieved the stored representation thereof and converted that representation back into an analog signal for output to the amplifier 24. During the supervisory process, the output from the amplifier 24 can be disabled so as not to alarm individuals in the vicinity of one or more of the output transducers such as loud speakers 30.

Coupled between the amplifier 24 and the speakers 30 is audio cable supervisory circuitry 40. While the system 10, as illustrated in FIG. 1, can be used with circuitry 40, it will be understood that the circuitry 40 is not a requirement. The system 10 can be directly coupled to the speakers 30 by cable 24*a*.

Figure 2:
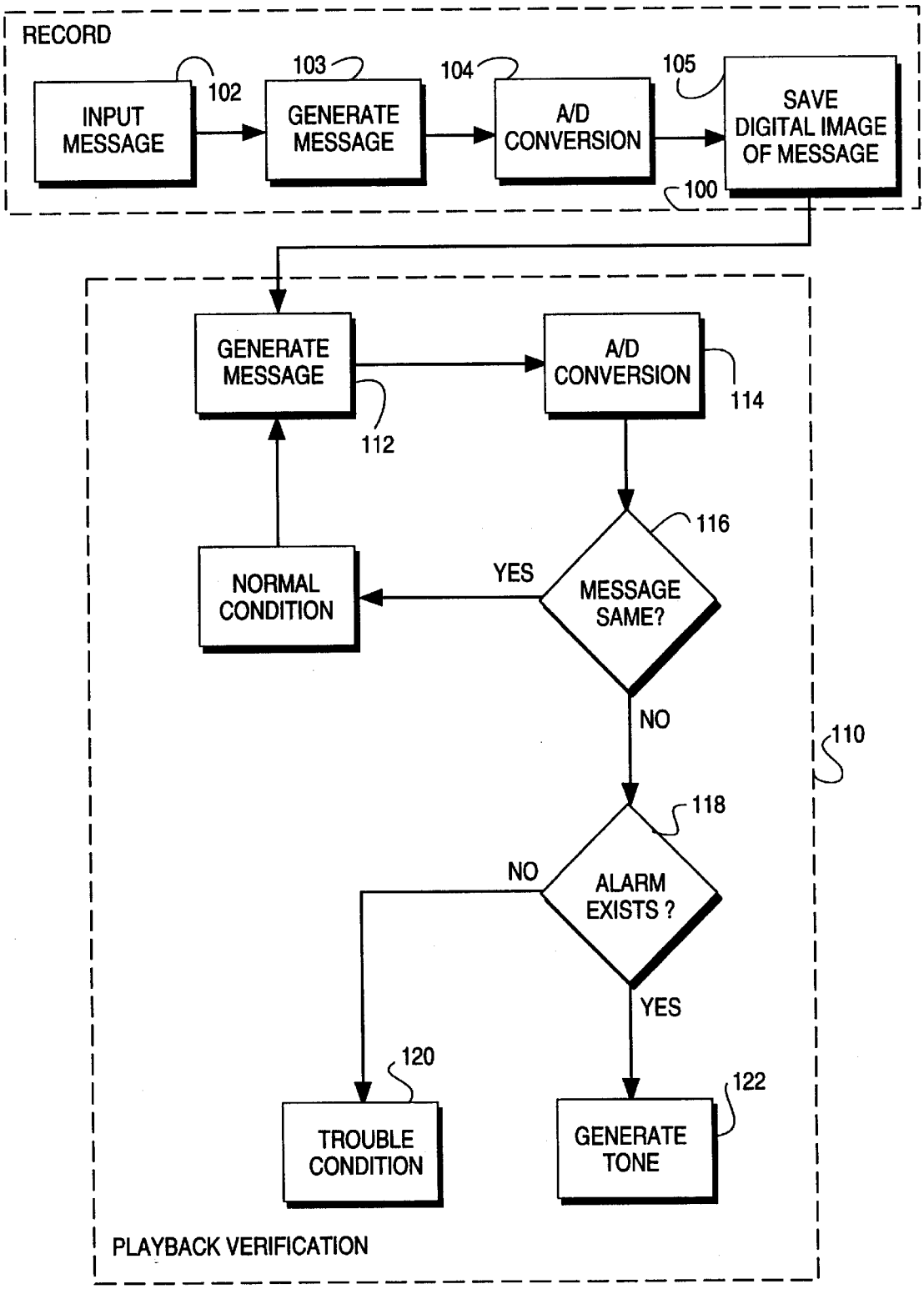
FIG. 2 is a flow diagram illustrating steps of a method of supervising the generator of FIG. 1.

FIG. 2 illustrates the steps of a process of supervising the functioning of generator 12. In a first phase 100, one or more messages is recorded in both generator circuitry 12 and control element circuitry 16.

In a step 102 a message is input. That message is stored in the generator 12. The stored message is read out from the generator 12 as an audio, analog output, in a step 103. The message is then sampled by converter 18 in a step 104. The sampled representation is stored in control element 16 in step 106.

For filtering and smoothing purposes, the converter 18 can make multiple samples, for example four samples, at each sample point of the message being stored. In this instance, an average value can then be stored by the control unit 16. The averaged value, a binary image of the message can be stored for example in nonvolatile memory.

Subsequently, in a verification phase 110, the generator 12 on line 12*d* produces an analog representation of a selected prestored message in a step 112. That analog representation is converted in a step 114 via converter 18.

The result of the conversion step 114 is then compared with a respective prestored image of the message by control unit 16 in a step 116. If the two representations are substantially the same, the generator 12 can be expected to be operating in a normal condition and another message can be generated for supervisory purposes.

In the event that the messages are different, in a step 118, a determination is made as to whether an alarm state is present. If the system is not in alarm, a trouble or error indicator can be generated for operator follow-up or action in a step 120. Alternately, if this event occurs while the system is in an alarm state, the tone generator 21 can be used to provide an audible signal to the transducers 30 in a step 122. The tones will be output instead of the pre-stored messages.

Figure 3:
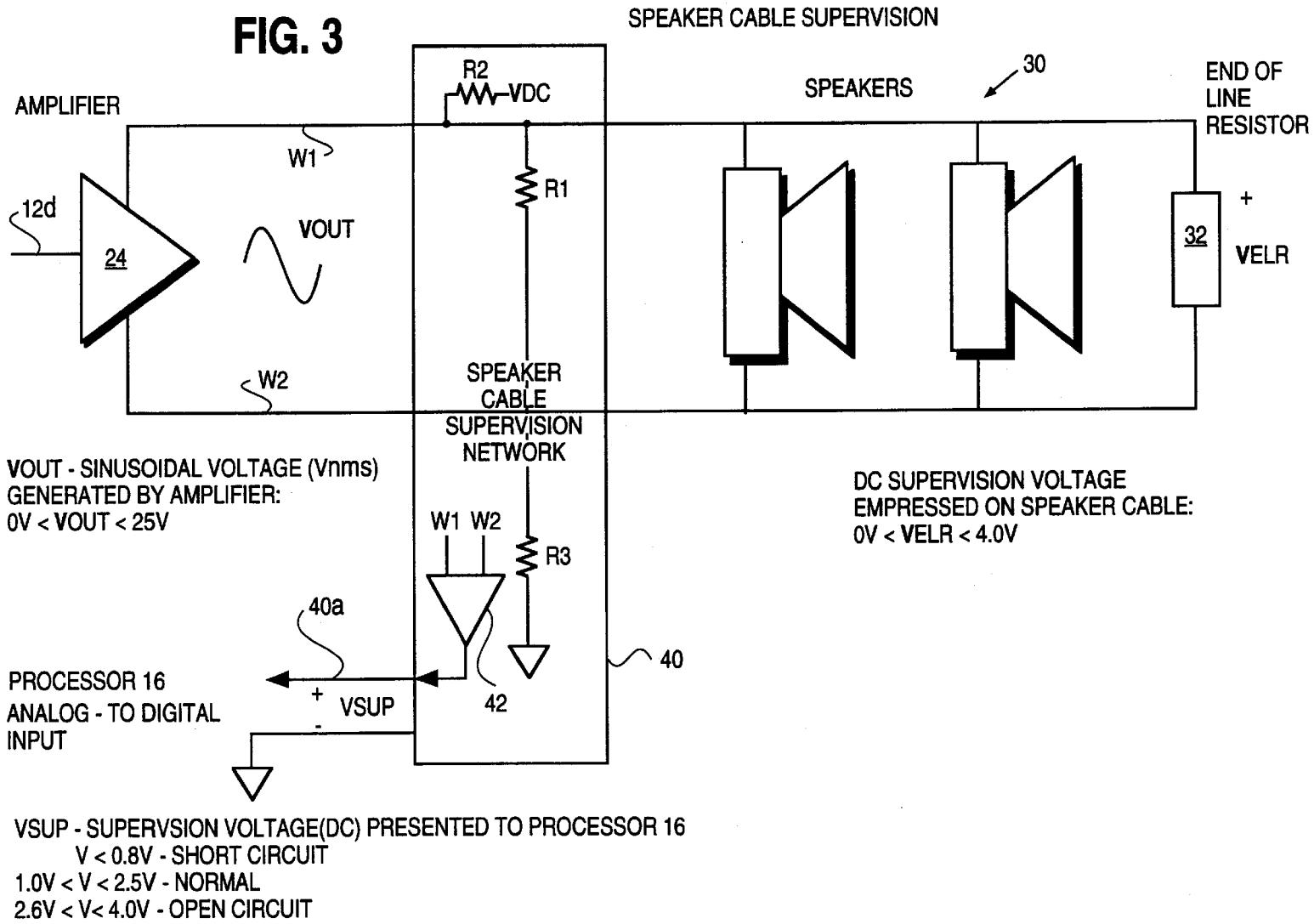
FIG. 3 is a block diagram illustrating exemplary audio output cable supervisory circuitry.

FIG. 3 illustrates details of exemplary audio cable supervisory circuitry 40. Cable supervision is carried out using out of band supervisory signals.

An output band of communications signals such as audio is used for audible voice messages, tones, background music and the like. This band could also include ultrasonic or non-audible frequencies. Supervisory, out of band, signals that can be separated from the communications signals are used for cable supervision.

As illustrated in FIG. 3, a differential output from the amplifier 24, on conductors W1 and W2 is coupled to the plurality of speakers 30. The supervisory circuitry 40 includes a first resistor R1 coupled across the conductors W1 and W2 in parallel with an end of line element 32. The element 32 could be a resistor of a selected value.

A second resistor R2 is coupled between one end of resistor R1 and a source of DC voltage. A third resistor R3 is coupled between a second end of the resistor R1 and ground.

The exact value of the DC voltage source is not a limitation of the present invention. Forty volts can be used for example.

An instrumentation amplifier 42 is coupled across the audio output conductors W1 and W2 and produces a single-ended output on the line 40*a*. In an exemplary embodiment, resistors R2 and R3 are chosen to have substantially equal resistance values. Resistor R1 is chosen to have a resistance value substantially equal to that of the end of line element 32.

These resistor value ratios can be chosen so that under normal conditions the difference between the voltage from conductor W1 to ground and voltage from conductor W2 to ground will be half way between the maximum voltage difference and the minimum voltage difference. Since R3=R2, if conductors W1 and W2 become shorted together, the voltage from W1 to ground (V1) and voltage from W2 to ground (V2) will be equal, therefor the difference=zero Vdc (minimum voltage). If the end of line element 32 is no longer in parallel with R1 for whatever reason (open wire, not connected etc.), the maximum differential voltage between W1 and W2 will be present.

The end result is three distinct differential voltage level ranges that correspond to three wiring conditions. The NORMAL (end of line element 32 in place, no wire faults) condition results in a nominal voltage level of 2 Vdc. The OPEN (no end of line element 32 or an open wire fault) condition is represented by a voltage level of 4 Vdc. The SHORT (end of line element 32 shorted, W1 and W2 shorted together) condition is represented by a voltage level of 0 Vdc.

The differential voltage is fed through the instrumentation amplifier 42 whose output is input to the analog-to-digital converter. Software or control programs for the unit 16 periodically performs an analog to digital conversion on the instrumentation amplifier output voltage (Vsup). Where the amplifier gain equals 1, the supervisory voltage levels defined previously will remain the same. A nominal range of 1.5–2.5 Vdc for NORMAL, >3 for OPEN, and <1 Vdc for SHORT can be used. Based on these three voltage ranges, the control unit 16 determines whether a trouble condition (Short or Open Wire Fault) exists and in response thereto generates a visual or audible indication or message.

In order to provide supervision while audio voltage is present on the output lines W1, W2, the AC audio voltage is filtered out. This can be accomplished via low pass filters on each input of the instrumentation amplifier 42 as well as positive and negative feedback filters in the amplifier's output stage. Since the supervisory voltage is DC, the audio output is not affected.

Figure 4:
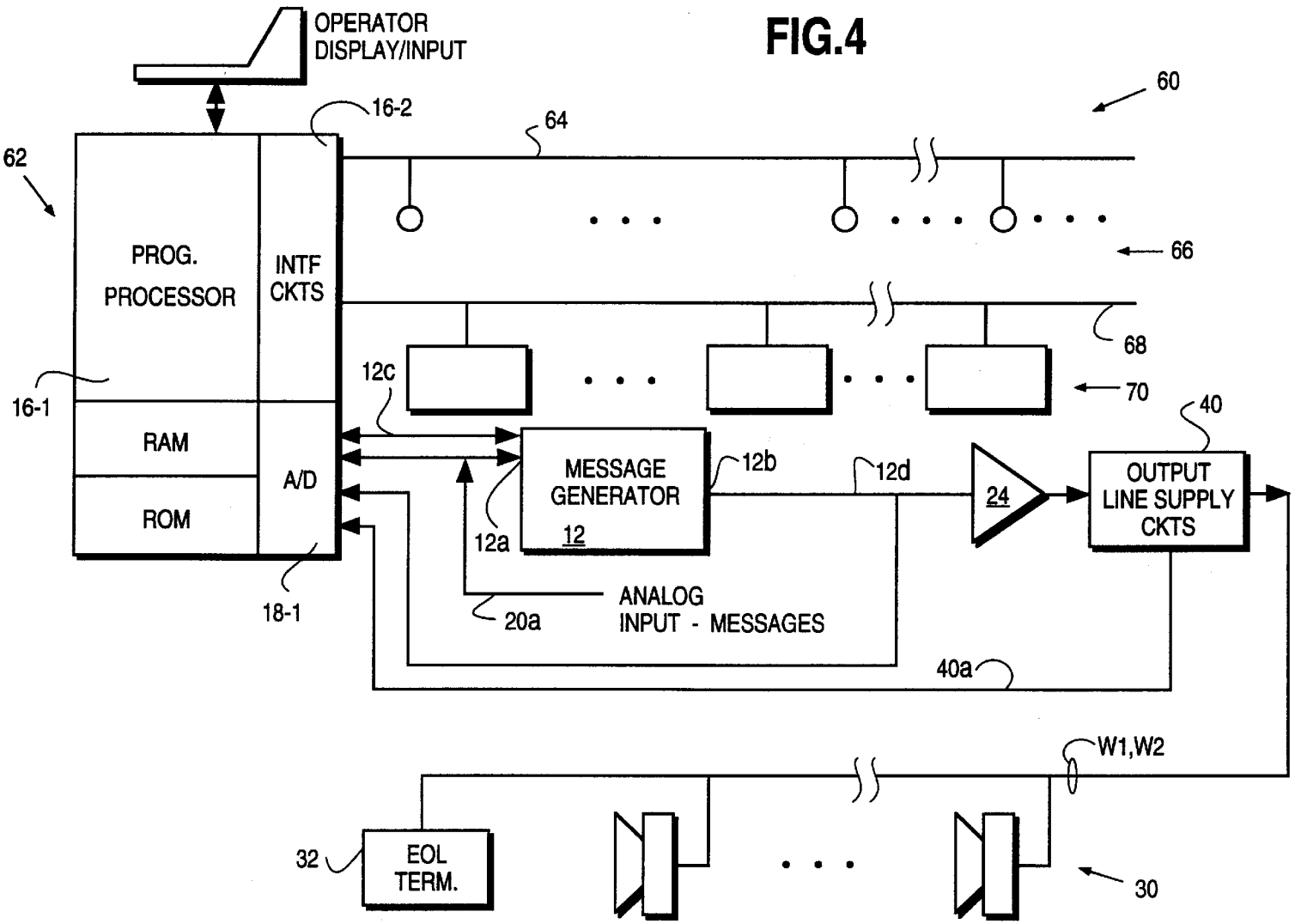
FIG. 4 is a block diagram of an ambient condition detection system which incorporates supervisable message generation circuitry.

FIG. 4 illustrates in block diagram form an ambient condition detection system 60 which incorporates annunciator supervisory circuitry, such as the circuitry 10. Elements of the system 60 which have been previously discussed have been identified with previously assigned identification numerals.

The exemplary system 60 is a form of an ambient condition supervisory system such as might be used to monitor a region for intrusion, fire, gas or the like. System 60 includes a control unit 62.

The control unit 62 incorporates a programmable processor unit 161, comparable to the control unit 16. The unit 16-1 is coupled by interface circuitry 16-2 to a communication link 64. The communication link can, for example, enable the unit 16-1 to carry on bidirectional communications with a plurality of modules 66.

The plurality 66 can include as a subgroup a plurality of ambient condition detectors. Representative detectors include motion sensors, entry/access indicators, fire detectors such as smoke, flame or thermal detectors as well as gas detectors.

The interface circuit 16-2 are also coupled to a communication link 68. The link 68 enables processing unit 16-1 to communicate with a plurality of output devices 70. The devices 70 could include audible and visual indicators such as horns or strobe units.

The interface circuitry 16-2 is also coupled to message generation circuitry 12. Analog input signals, which could be from a microphone or another prestored source of messages are coupled by the line 20*a* to both the message generator 12 and analog/digital converter 18-1 which operates under the control of processing unit 16-1. Other elements of the message generation system of the system 60 correspond to the elements previously discussed with respect to FIGS. 1–3. No further discussion thereof is necessary.

In operation, system 60 is driven by a plurality of control programs, some of which are resident at the unit 62. Others are resident at various members of the pluralities 66, 70 and at the message generator 12.

In response to a detected predetermined condition, such as a fire profile, the system 60, as will be understood by those skilled in the art, will actuate the alarm indicating members of the plurality 70. Additionally, the unit 62 can, via a message generator 12, generate audible messages for individuals throughout the region being supervised via the plurality of output transducers, loudspeakers 30.

As discussed, previously the processor 16-1 is able to supervise the operation of the message generation system 12. The processor 16-1 is also able to supervise conditions on the output audio lines W1 W2.

It will be understood that the system 60 could use and supervise the message generator 12 to the exclusion of the output line supervisory circuit 40 if desired.

The output audio lines can be supervised when no communication is present thereon (standby) and during times when a communication is being sent to the transducers 30. Tones can be automatically generated, by the generator 21, if the message generator 12 does not properly respond to the supervision process. This thus provides a back-up form of communication for individuals in the region being supervised. Both the message generator 12 and the tone generator 21 can be supervised when the system is in a quiescent, stand-by state or while in an active state.

From the foregoing, it will be observed that numerous variations and modifications may be effected without departing from the spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. Message generation supervisory circuitry comprising:

a first message unit for storage of a sampled message corresponding to an audio input;

an output system for producing an audio output in accordance with the stored, sampled message;

a supervisory element which includes a prestored representation of the audio input and circuitry for comparing the audio output to the prestored representation.

2. Circuitry as in claim 1 wherein the supervisory element includes binary storage circuitry which receives and stores a sampled, binary representation of the audio input.

3. Circuitry as in claim 1 wherein the supervisory element includes a converter for converting the audio output to an output binary representation.

4. Circuitry as in claim 3 wherein the prestored representation is a binary representation of the audio input.

5. Circuitry as in claim 4 wherein the supervisory element includes circuitry for generating a signal indicative of the output of the comparing circuitry.

6. Circuitry as in claim 1 which includes at least one audio output cable and applying circuitry, coupled to the cable for applying a supervisory signal thereto.

7. Circuitry as in claim 6 which includes sensing circuitry for sensing a representation of the supervisory signal.

8. Circuitry as in claim 7 wherein the applying circuitry couples a DC bias to the audio output cable.

9. Circuitry as in claim 7 wherein the sensing circuitry includes circuitry for detecting the presence of a predetermined status-indicating electrical parameter on the cable.

10. A monitoring system with a supervisable audible output comprising:

circuitry for generating a pre-stored audible indicator; and supervisory circuitry, coupled to the generating circuitry, for comparing a pre-stored sampled representation of a selected audible indicator to an analog output corresponding to the selected audible indicator previously sampled and stored.

11. A system as in claim 10 wherein the generating circuitry includes circuitry for storage of a sampled representation of at least one audible indicator.

12. A system as in claim 11 wherein the generating circuitry includes circuitry for converting the sampled representation to an analog output.

13. A system as in claim 12 which includes at least one transducer for converting the analog output to a humanly perceptible, audible signal.

14. A system as in claim 12 wherein the supervisory circuitry includes a read/write memory element for storage of at least one sampled representation of the selected audible indicator.

15. A system as in claim 11 wherein the supervisory circuitry includes a read/write memory element for storage of at least one sampled representation of the selected audible indicator.

16. A system as in claim 15 which includes an audio input transducer coupled to the generating circuitry.

17. A system as in claim 10 wherein the supervisory circuitry comprises a programmed processor.

18. A system as in claim 17 wherein the programmable processor includes instructions for sampling and storage of at least one representation of a selected audible indicator.

19. A system as in claim 18 which includes a communications link coupled to the processor.

20. A system as in claim 19 which includes at least one ambient condition detector coupled to the link.

21. A system as in claim 20 wherein at least one of the detectors includes a fire sensor.

22. A system as in claim 20 wherein the generating circuitry includes a plurality of audible indicators stored in a non-analog format.

23. A system as in claim 20 wherein the programmable processor includes instructions for multiple sampling of an entered audible indicator.

24. A system as in claim 20 wherein the processor includes instructions for causing the generating circuitry to output a pre-stored audible indicator in analog form, for sampling that analog output and for comparing the sampled output to at least one pre-stored, sampled representation of the analog output.

25. A system as in claim 24 wherein the processor includes instruction for providing an indication in response to the comparing step.

26. A system as in claim 25 wherein the processor includes instructions for processing outputs received from the ambient condition detector.

27. A system as in claim 26 wherein the detector includes a fire sensor and wherein the processing instructions comprise fire profile determining instructions.

28. A system as in claim 19 which includes a plurality of ambient condition detectors coupled to the link.

29. A supervisory system for a communications link comprising:

circuitry for impressing on the link an out-of-band monitoring signal;

circuitry for isolating the monitoring signal from any communications signals on the link; and circuitry for sensing the isolated monitoring signal and for generating a quality indication thereof.

30. A system as in claim 29 wherein the impressing circuitry applies a d.c. bias as a monitoring signal to the link.

31. A system as in claim 30 wherein the sensing circuitry includes a d.c. level detector.

32. A system as in claim 31 wherein the detector includes an amplifier with a differential input and which produces a single ended output.

33. A system as in claim 29 wherein the sensing circuitry includes at least one voltage divider adapted to be coupled to the communications link.

34. A system as in claim 29 wherein the supervisory circuitry applies a time-varying monitoring signal to the link.

35. An ambient condition monitoring system comprising:

a control unit;

a plurality of ambient condition detectors coupled to the unit;

a system for generating audible output messages coupled to the unit;

circuitry for supervising the system for generating audible output messages;

at least one communication output transducer coupled to the message generating system by an audible message output link; and output link supervision circuitry coupled to the unit wherein the link is supervisable while a communication is being output by the transducer.

36. A monitoring system as in claim 35 wherein the control unit includes storage for copies of available audible messages for use in supervision.

37. A monitoring system as in claim 36 wherein the control unit includes storage for at least one range of parameters for output link supervision.

38. A monitoring system as in claim 35 which includes storage for at least three ranges of parameters for output link supervision.

39. A monitoring system as in claim 35 wherein the output link includes first and second conductors and wherein the supervision circuitry includes a voltage divider coupled, at least in part, across the conductors.

40. A monitoring system as in claim 35 wherein at least some of the detectors each include a fire sensor.

41. A monitoring system as in claim 40 wherein at least some of the fire sensors comprise smoke detectors.

42. A monitoring system as in claim 35 wherein the communication output transducer comprises an audio output device and the communication is humanly discernable.

43. A method of supervising an output communication link in a selected system, wherein communications on the link are intended to take place in a predetermined band, the method comprising:

establishing an out-of-band supervisory signal;

applying the supervisory signal to the link;

detecting a representation of the applied supervisory signal;

and comparing the detected representation to a predetermined criterion.

44. A method as in claim 43 wherein the supervisory signal is applied to the link in the presence of a communication on the link.

45. A method as in claim 44 wherein the communication includes at least one predetermined signaling tone.

46. A method as in claim 44 wherein the communication includes a pre-stored message.

47. A method as in claim 44 wherein the communication includes at least one audibly discernable segment.

48. A method as in claim 43 wherein the establishing step includes providing a substantially constant potential supervisory signal for the link.

49. A method of supervising a message generator comprising:

establishing and storing at least one message to be produced by the generator;

generating the stored message and forming a binary representation thereof;

storing the binary representation;

subsequently, generating the stored message and forming another binary representation thereof;

comparing the binary representation to the another representation.

50. A method as in claim 49 including, in response to the comparing step, generating a signal indicative of a difference between the representations.

51. A method as in claim 50 wherein in response to the signal, at least one audible tone is generated instead of the stored message.

52. A method as in claim 49 including, in response to the comparing step, generating a signal indicative of substantial identity between the binary representation and the another representation.

53. A method as in claim 52 wherein in response to the signal, at least one stored message is generated and converted to a humanly discernable output signal.

* * * * *